US006505995B2

(12) United States Patent
Sanfilippo et al.

(10) Patent No.: US 6,505,995 B2
(45) Date of Patent: Jan. 14, 2003

(54) ROAD-MARKING MACHINE

(75) Inventors: Angelo Sanfilippo, Biot; Gilbert Bernard, Cabris, both of (FR)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/798,834

(22) Filed: Mar. 1, 2001

(65) Prior Publication Data

US 2001/0024596 A1 Sep. 27, 2001

(30) Foreign Application Priority Data

Mar. 21, 2000 (EP) ..... 00400775

(51) Int. Cl.[7] ..... E01C 23/16

(52) U.S. Cl. ..... 404/94; 239/99; 239/150; 239/752; 222/611.1; 222/620

(58) Field of Search ..... 404/93, 94; 239/99, 239/100, 101, 150, 750, 752, 754, 156, 157, 264; 222/611.1, 613, 614, 620, 621

(56) References Cited

U.S. PATENT DOCUMENTS 4,401,265 A * 8/1983 Hofmann ..... 239/172 X

FOREIGN PATENT DOCUMENTS

| | | |
|---|---|---|
| DE | 2941602 | 4/1981 |
| EP | 0791637 | 8/1997 |
| FR | 2575497 | 7/1986 |
| WO | 0654068 * | 5/1994 |

* cited by examiner

*Primary Examiner*—David Bagnell
*Assistant Examiner*—Sunil Singh

(57) ABSTRACT

A road-marking device which sprays thick ribs of paint to a road surface, transversely to the road axis, to form rumble strips is disclosed.

5 Claims, 1 Drawing Sheet

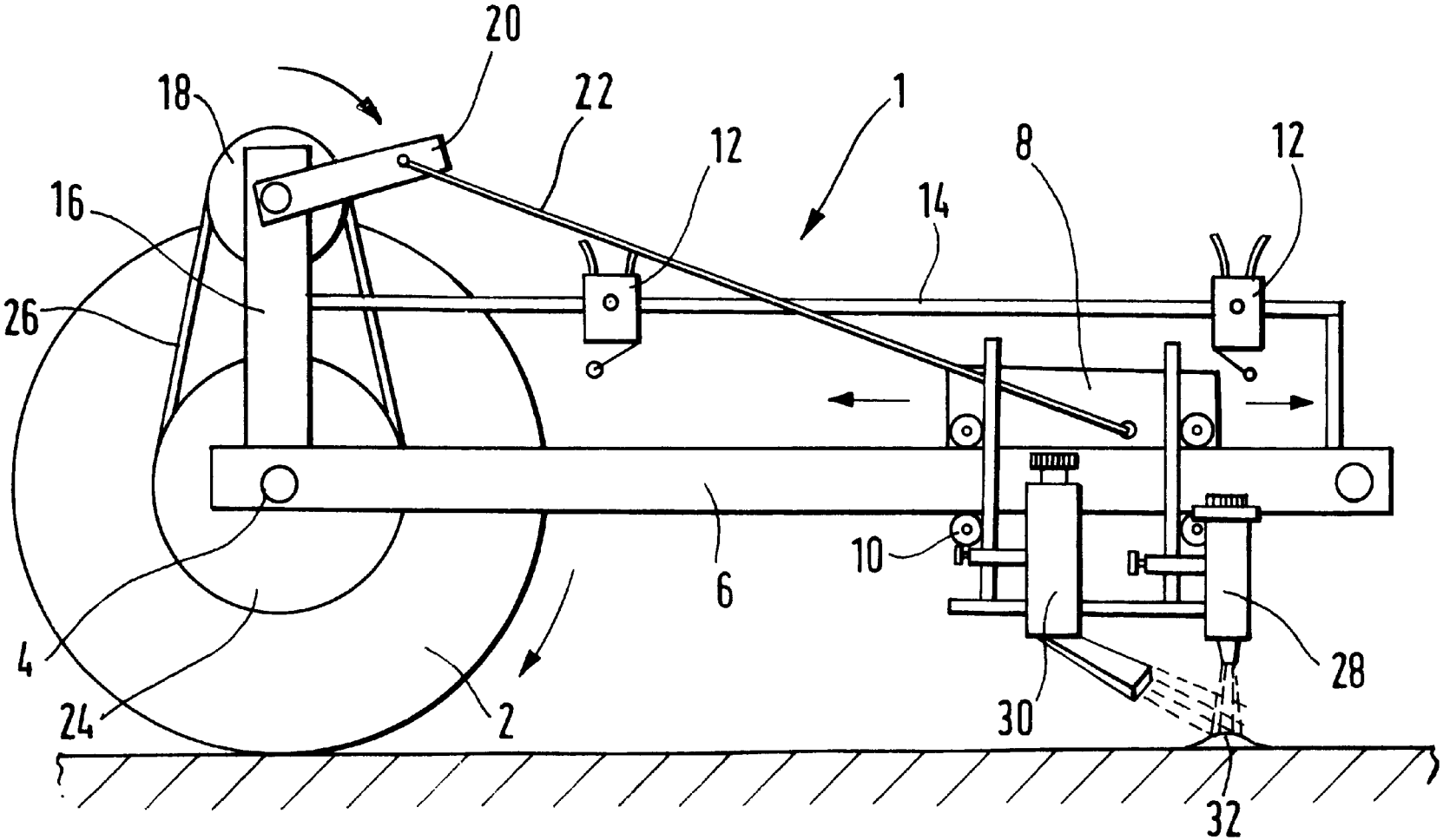
1
2
4
6
8
10
12
12
14
16
18
20
22
24
26
28
30
32

ROAD-MARKING MACHINE

It is known to provide so-called 'rumble strips' alongside major roads, in the form of spaced-apart ribs of white material extending transversely to the flow of traffic. When a vehicle on the road veers excessively towards the edge of the road, its wheels come into contact with the rumble strip. The contact of the tyre with the ribs causes the tyre to bounce from one rib to another. The resultant movement of the steering wheel, and the noise produced by the wheel suspension, draws the attention of the driver to the fact that his vehicle is in danger of running off the road. Such rumble strips have been produced by the application of a hot thermoplastic material to the road surface and, while it is still plastic, applying a mould to the top surface of the strip to form a short series of ribs extending upwardly from the top surface of the strip. Another known technique is to apply a two-component material to form the ribs. The application of thermoplastic material needs costly equipment, so that both known techniques are relatively expensive, and also provides no visual signals to drivers, as light is reflected both from the ribs and from the intervening strip.

The present invention aims at providing a machine by means of which a thick layer of a water-based paint is blasted at a specific location on a road surface to form an upstanding rib of material which offers a visual contrast with the adjacent road surface, and which is of sufficient height to form one of the ribs of a rumble strip.

Accordingly, the present invention provides a road-marking machine that is as claimed in the appended claims.

The invention will now be described by way of example with reference to the accompanying drawing, which is a side view of the machine of this invention when in its operating condition.

In use, the machine would be attached to a road vehicle (not shown). As the means by which the machine is held in place on the vehicle, and supplied with paint and pneumatic or other form of power, do not form part of the subject-matter of this invention, they are not described herein in any further detail.

The machine 1 includes a road wheel 2 in frictional engagement with the road surface to which a rumble strip is to be applied. Extending substantially horizontally from the axle 4 of the wheel 2, and forwardly thereof, is a support bar 6. Mounted on the bar is a paint head carriage 8 having anti-friction rollers 10 engaging the upper and lower surfaces of the bar. The carriage is constrained to be movable in both directions along the bar. As it does so, the carriage comes into contact with two microswitches 12 positioned on either side of the centre point of its range of travel. The switches 12 are positioned at adjustable points on an auxiliary support bar 14, for reasons that will be discussed below.

Extending upwardly from the bar 6, at its meeting with the axle 4, is an upright member 16 carrying a slave wheel 18 at its upper end. Extending radially from the axis of the wheel 18 is a drive bar 20 having a rod 22 pivotally coupled to it. Associated with the drive wheel 2 is an auxiliary wheel 24. Engaging both the wheel 24 and the wheel 18 is a flexible drive member 26 in the form of a chain or belt. By means which are not shown, the member 26 is kept in tension despite changes in its length because of temperature changes and wear. The effect of member 26 is to ensure that the bar 20 is rotated at a speed which is related to the speed of rotation of wheel 2. As the end of the bar 20 moves in a circle, it causes the carriage 8 to be moved along the bar in simple harmonic motion by force transmitted to the carriage by rod 22, acting alternatively as a strut and a tie.

The carriage 8 has mounted on it a spray head 28 for paint, and one 30 for ballotini used to increase the reflectivity of the applied paint. Each spray head includes an electrically-operated valve (not shown) of which the timing of operation is controlled by the switches 12. As the vehicle carrying the machine 1 moves along the road, the bar 6 also moves at a uniform speed. When the carriage is being pushed along the bar 6 away from the wheel 2, its speed relative to the underlying stretch of road surface is greater than the road speed. The respective valves are arranged to be kept closed during this phase of the movement of the carriage. However, when the carriage is being pulled towards the wheel 2, its speed over the ground is less than the road speed, and may be zero for a short period. It is during this phase of its movement that the valves are opened and closed by the switches 12, when the spray head 28 is moving only slowly relative to the road. When the forward switch opens the valve, to cause the paint to be ejected at the road, the spray head 28 is moving slowly forwards. Its speed decreases to zero, and then it starts to move backwards relatively to the road, spraying continually as it does so. This continues until the carriage meets the rearward switch, and closes the valve. During the spraying period, the head moves a small distance in the direction of travel, thus laying down a rib 32 of width controlled by the positions of the switches 12.

The width of the head is roughly equal to the desired length of each rib 32 to be formed, and the period over which paint is ejected from the head 28 determines the width of the rib. The volume of paint discharged over this period determines the height of the rib. Preferably the paint to be used is water-based. Although the deposited paint may be dried conventionally (by flames or other heat-transfer medium (not shown)), according to one feature of this invention the paint is made to set extra rapidly by injecting into the paint, either immediately before, or immediately after, it issues from the head 28, particles of a solid polymer or inorganic compound, which particles are capable of absorbing water. Preferred particles are of an ion-exchange resin such as is disclosed in EP-A-0 791 637, in the name of Rohm and Haas (UK) Ltd. Preferred resins of this type are those sold under the trade names Amberlyst and Amberjet by Rohm and Haas. The resin may be applied by means of the spray head 30, or another spray head (not shown) may be used. When small glass beads (ballotini) are to be used to increase the reflectivity of the ribs, they may be sprayed out of head 30 mixed with the powdered resin, or sprayed separately therefrom. When a separate head is used for the resin, the period over which the resin particles are sprayed into the paint issuing from the spray head may be different from that over which the ballotini are sprayed.

Because paint is sprayed at the road surface at discrete intervals, related to the instantaneous location of the carriage on the bar, and because the vehilcle acarrying the machine is moving at a uniform speed, the ribs are spaced apart from each other. Preferably the ribs are formed of white or other light-coloured paint, so that each rib formed by this machine is visually differentiated from the adjacent road surfaces, giving drivers a visual warning, as well as auditory and tactile ones, when the vehicle is approaching or traversing the respective rumble strip. However, in some instances, it may be preferred to apply a continuous broad stripe of paint on top of, and/or to one side of, the line of ribs. Accordingly, it will be seen that this invention provides a simple machine by means of which paint may be sprayed at road surfaces to build up thick deposits of paint in the form of spaced-apart transverse ribs of controlled dimensions.

What is claimed is:

1. A machine (1) for applying paint to road surfaces, comprising a bar (6) intended to be moved along the road at a uniform speed and in line with the road axis;, the bar carrying a carriage (8) mounted for reciprocal movement along the length of the bar;

the carriage carrying at least one spray head (28) for projecting a spray of paint at the underlying road surface;

the carriage further carrying a spray head (30) for spraying ballotini and/or particles of water-absorbing material into the spray of paint issuing from head (28);

the carriage in its travel being intended to operate at least one adjustably-positioned switch (12); and the at least one adjustably-positioned switch controlling the timing of operation of the at least one spray head (28) and the timing of the spray head (30) so that the at least one spray head projects onto an underlying road surface a spray of paint in the form, when dried, of a thick rib (32).

2. A machine as claimed in claim 1, in which the bar is supported at one end by a wheel in frictional engagement with the road, and in which rotation of the wheel is converted into reciprocal movement of the carriage along the bar.

3. A machine as claimed in claim 1, in which the paint issues from its spray head in a substantially-vertical direction, and in which the particles of water-absorbing material enter the paint spray at an acute angle to the road surface.

4. The machine as claimed in claim 1, in which the at least one adjustably-positioned switches comprises two microswitches (12) that are mounted on an auxiliary support (14) extending in parallel with the bar (6), the switches having their operating members lying in the path of the carriage, and being adjustably positioned along the length of the auxiliary support.

5. The machine as claimed in claim 1 or claim 3, in which the water-absorbing material is an ion-exchange resin.

* * * * *